United States Patent [19]

Inose et al.

[11] 4,175,477

[45] Nov. 27, 1979

[54] PLATE TYPE PUNCHING MACHINE

[76] Inventors: Tadao Inose, 20-52, 2-chome; Minoru Hirota, 20-13, 2-chome, both of Higashi, Koga-shi, Ibaragi-ken, Japan

[21] Appl. No.: 850,346

[22] Filed: Nov. 10, 1977

[30] Foreign Application Priority Data

May 7, 1977 [JP] Japan ..... 79455

[51] Int. Cl.[2] ..... B31B 1/74

[52] U.S. Cl. ..... 93/36 A

[58] Field of Search ..... 93/36 A, 59 ES

[56] References Cited

U.S. PATENT DOCUMENTS

| | | | |
|---|---|---|---|
| 3,055,275 | 9/1962 | Schroter | 93/36 A |
| 3,060,776 | 10/1962 | Bobst et al. | 93/36 A X |
| 3,786,731 | 1/1974 | Bobst et al. | 93/36 A |
| 3,865,020 | 2/1975 | Erba et al. | 93/36 A |

*Primary Examiner*—James F. Coan

*Attorney, Agent, or Firm*—Marshall & Yeasting

[57] ABSTRACT

A plate type punching machine in which sheets of paper supplied to the machine are transferred intermittently while held by sheet holding pawls on endless chain belts. Upon reaching the punching die, each sheet is formed with cut lines. This sheet is placed on a board and the cut sections are removed by remover bars in remover bar frames arranged movable vertically on both upper and lower sides of the board. The board is supported by a support which is carried by a mount such that the support is movable out of or into one side of a machine frame. The end on one side of the mount is pivotally secured to the machine frame by pins so that the mount is pivotable up and down about the pins. The other side end of the mount is pivotally joined to rods whose other ends are joined to eccentric shafts connected to a bevel gear. The bevel gear is meshed with another bevel gear secured to an end of a shaft which has provided at its other end a handle.

3 Claims, 5 Drawing Figures

PLATE TYPE PUNCHING MACHINE

FIELD OF THE INVENTION

This invention relates to a plate type punching machine in which sheets of paper supplied to the machine are transferred one after the other intermittently to a punching die. The sheet formed with lines of cuts or folds by the punching die is placed on a board so that the cut sections or tailings are removed from the sheet by remover bars in bar frames movable vertically on both upper and lower sides of the board.

BACKGROUND OF THE INVENTION

In order to effect proper removal of the cuttings from each sheet punched by a plate type punching machine, it is essential to correctly place on a board the punched sheet held by sheet holding pawls on endless chain belts supported on rails laid along both sides of the board. It is also necessary to adjust the mounted position of the board on its support for registering the holes in the board and remover bars with the locations of the tailings in the sheet, but as the rails of the endless chain belts are disposed on both sides of the board, it is impossible to draw out the board and the support sidewise of the machine. Therefore, such registration of the remover bars and board holes has been performed by manual adjustment of the board by a worker who entered a space inside the machine. Such board adjusting work was very troublesome and time-consuming.

SUMMARY OF THE INVENTION

An object of this invention is to provide a plate type punching machine designed to allow easy adjustment of the board, in which a mount carrying the board and its support is provided such that the end on one side thereof is movable about pivot means so as to allow easy draw-out of the board and its support to one side of the machine. The drawn-out board is adjusted at said side of the machine and set in position on its support, and after properly placing said support on its mount, the latter is again turned about the pivot means to bring it back to its original position.

Another object of this invention is to provide a plate type punching machine of the type described, in which the board support carried on its mount is locked during operation, but when the positional adjustment of the board is made, said support is unlocked so that it can be drawn out from the mount along with the board.

Still another object of this invention is to provide a punching machine of the type described, in which the ends of rods are pivotally joined to one side end of the mount, with the other ends of said rods being pivotally joined to corresponding eccentric shafts so that when said eccentric shafts revolve, the mount is accordingly turned about the other side end thereof and can be thereby drawn out to one side of the machine along with the board, with said board and the other side end of said mount being placed below the rails.

A further object of this invention is to provide a punching machine of the type described, in which a pair of remover bar frames carrying remover bars for tailings are provided above and below the assembly of the board, support and mount, said remover bar frames being so connected to each other as to be movable up and down. The remover bar frames are drawn out to one side of the machine to allow easy mounting and demounting of said remover bars in their frames as well as positional adjustment thereof.

Other objects will be understood from the following detailed description of the invention.

DETAILED DESCRIPTION OF THE INVENTION

Figure 1:
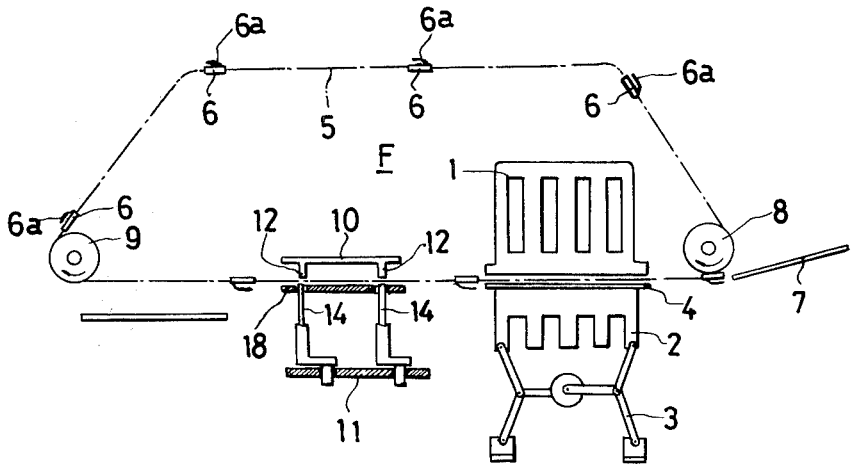
FIG. 1 is a diagrammatic side elevational view of a plate type punching machine according to this invention.
Figure 2:
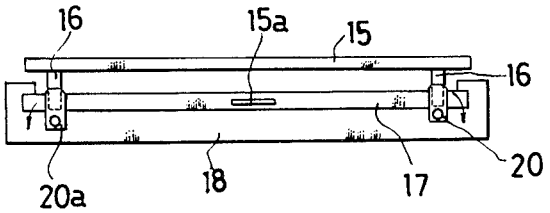
FIG. 2 is an enlarged side view of a board, support and mount assembly.
Figure 3:
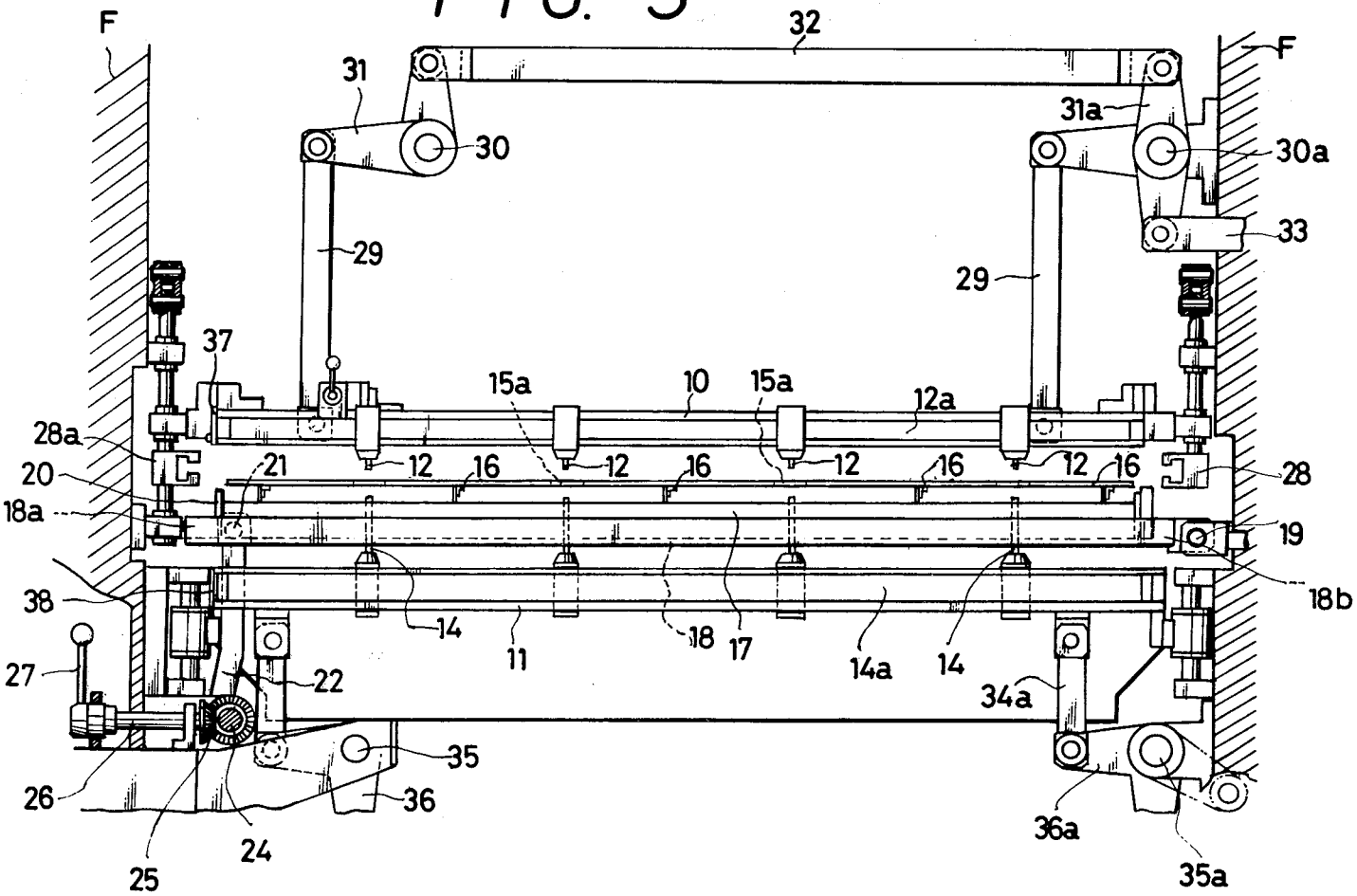
FIG. 3 is an enlarged side elevational view of the remover bar frames and said board, support and mount assembly.
Figure 4:
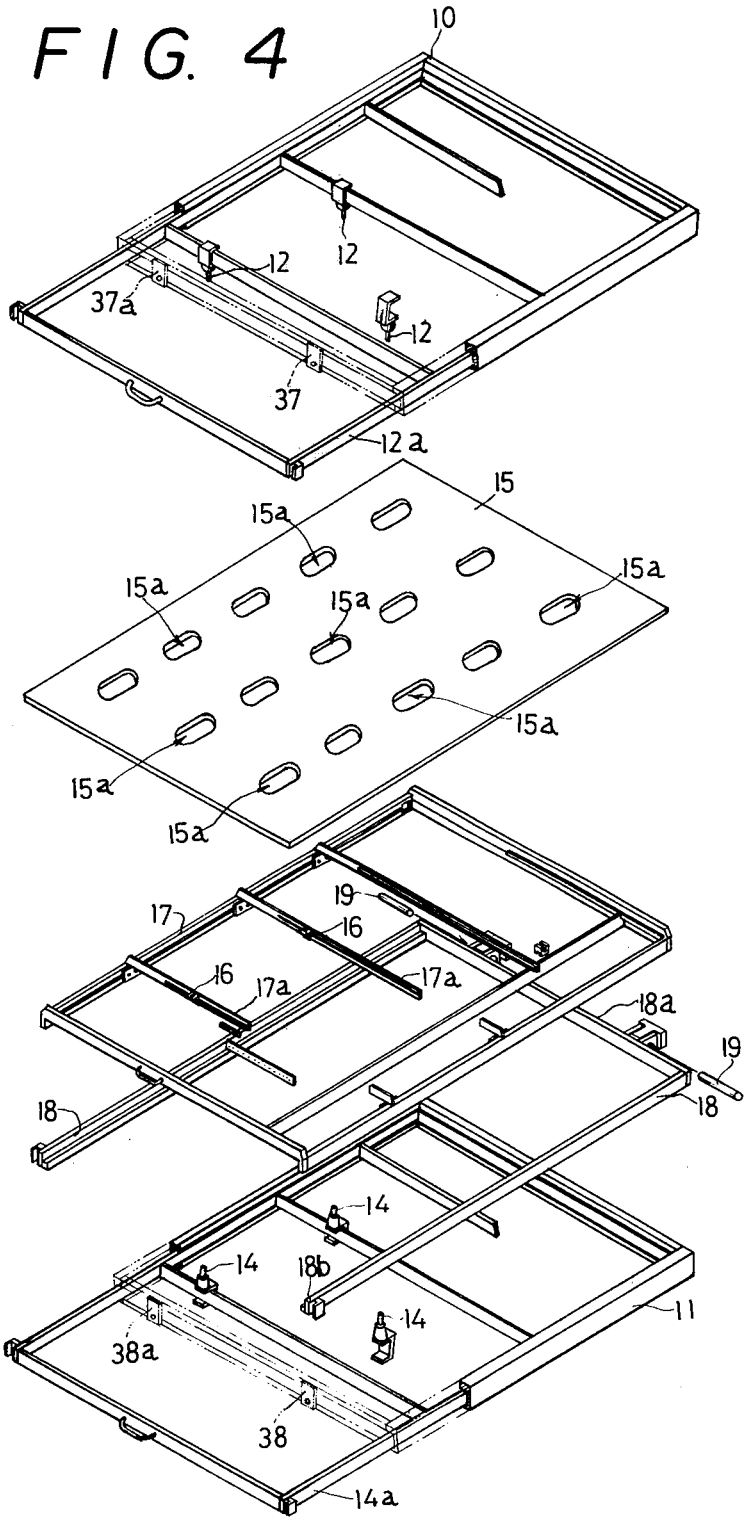
FIG. 4 is an enlarged exploded perspective view of the board support, its mount, base and parts of the remover bar frames.
Figure 5:
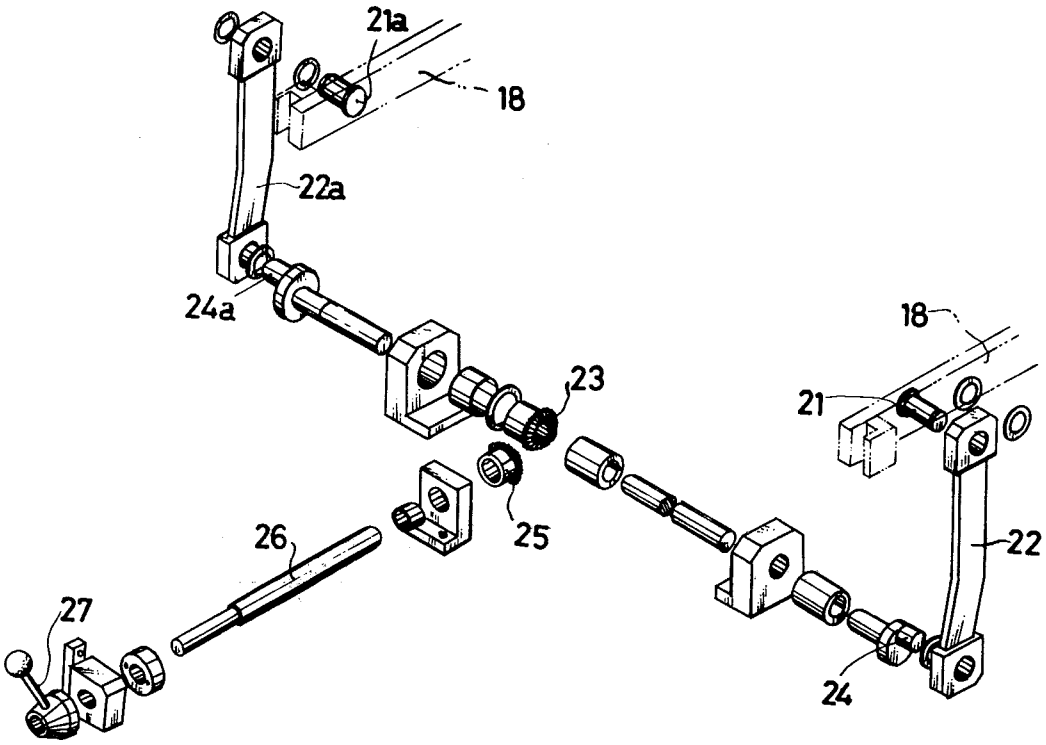
FIG. 5 is an enlarged perspective view of a mechanism, including a handle, bevel gears and rods, for moving one side end of the mount vertically about the pins at the other side end thereof.

Referring to FIG. 1, there is shown a general diagrammatic illustration of a plate type punching machine. Reference numeral 1 indicates a fixed platen adapted to a down-facing frame member (not shown), and reference numeral 2 indicates a movable platen disposed in opposition to said fixed platen 1 for forming lines of cuts for punching in a sheet A placed between said two platens while held by sheet holding pawls on endless chain belts 5. Said movable platen 2 is moved vertically by a toggle mechanism 3.

F designates a machine frame in which said endless chain belts 5 are passed round chain wheels 8, 9 journalled to both internal sides of said machine frame and guide rolls (not shown). When said chain wheels 8, 9 are rotated in the direction of the arrow by a known intermittent driving means, the sheet held by the sheet holding pawls of pawl bars 6 provided transversely on said endless chain belts 5 is accordingly transferred and cut between the fixed and movable platens 1 and 2 by their cutting edges.

Numeral 7 indicates a sheet feeder. Each sheet A supplied from said sheet feeder 7 is held or gripped by the sheet holding pawls 6 opened and closed by the action of cam means (not shown) and then is transferred on the endless chain belts 5 passed round the chain wheels 8, 9 at both ends of the machine frame F (the chain wheels on the opposite side being not shown in the drawing), until said sheet reaches the position just below the fixed platen 1, whereat the sheet is stopped. Then the toggle 3 is operated by its driving means (not shown) to raise up the movable platen 2 and the lines of cuts for distinguishing between blank and waste portions are formed in the sheet A by a punching board 4. Then the toggle 3 is again operated to lower the movable block 2 and the chain wheels 8, 9 are rotated to drive the endless chain belts 5 to bring the sheet A formed with said cut lines to the position just above a board 15 between blocks 10 and 11 carrying remover bar frames **12*a* and 14*a* and locked in position by locks 37, 37*a* and 38, 38*a*, and upon reaching this position, the endless chain belts 5** are stopped.

Levers **29, 29*a* are joined at one end to the block 10 to which the remover bar frame 12*a* is mounted so as to be movable out of or into one side of the machine frame F, with the other ends of said respective levers 29, 29*a*** being joined to the corresponding ends of the cranks 31, 31*a* pivoted at 30, 30*a* to the machine frame F. Said cranks 31, 31*a* are also pivotally joined to both ends of a connecting rod 32, and a lever 33 is joined to the other end of said crank 31*a*, whereby said both cranks 31 and 31*a* are operated simultaneously by pulling or pushing said lever 33 to thereby raise up or lower down the block 10. Likewise, levers 34, 34*a* are joined at one end to the block 11 mounted with the remover bar frame 14*a* so as to be movable out of or into one side of the machine frame F, with the other ends of said respective levers 34, 34*a* being joined to the corresponding ends of the cranks 36, 36*a* which are pivoted at 35, 35*a* to the machine frame F. The other ends of said cranks 36, 36*a* are connected by a connecting rod (not shown), and an operating bar of said crank 36*a* is connected to said lever 33 by a connecting rod (not shown) so as to interlock said both blocks 10 and 11. Thus, the tailings in the sheet A resting on the board 15 are removed by the remover bars 12, 14 set in the respective remover bar frames 12*a*, 14*a*, in synchronized operative relation with the endless chain belt driving wheels 8, 9 and gearing mechanism (not shown).

Also, locking and unlocking members 37, 37*a* and 38, 38*a* are provided for the respective blocks 10 and 11, whereby when the tailings removing operation is performed, the remover bar frames 12*a*, 14*a* are locked to the respective blocks 10, 11, and when said frames 12*a*, 14*a* are drawn out sidewise of the machine frame F for setting the remover bars 12, 14 in the frames 12*a*, 14*a* or for repair, said frames 12*a*, 14*a* are unlocked from the blocks 10, 11.

The board 15 is disposed between and parallel to the rails 28 and 28*a* and secured by screws or other means to the fixtures 16 adapted to the cross bars 17*a* of the support 17 so as to be movable or fixed. Numeral 18 denotes the mount on which the support 17 is mounted such that said support may be drawn out to one side of the frame F. One side 18*b* of said mount is pivotally joined to the machine frame F by pins 19, while rods 22, 22*a* are joined at one end by the other side 18*a* of said mount by pins 21, with the other ends of said respective bars 22, 22*a* being connected to the eccentric shafts 24, 24*a* pivotally secured to the machine frame F and connected to a bevel gear 23 which is meshed with another bevel gear 25 secured to a shaft 26 pivotally adapted to the machine frame F and joined at its other end to a handle 27.

When the handle 27 is turned clockwise or counterclockwise, the bevel gears 25, 23 are accordingly turned to revolve the eccentric shafts 24, 24*a*, causing the rods 22, 22*a* to move upwardly or downwardly. Thus, when the rods 22, 22*a* are moved upwardly, the mount 18 is turned about the pins 19 so as to maintain the board surface horizontal, while when said rods 22, 22*a* are moved downwardly, one side of the mount 18 is accordingly slanted downwards to have one side of the board 15 positioned below the rail 28. It is also possible to properly set the board 15 on the support 17 or to make microadjustment of its position on the support 17 by drawing out the board 15 with the support 17 to one side of the machine frame by pulling a catch 15*a*. In this case, of course the locking means 20, 20*a* on one side of the support 17 are released.

As described above, the board support 17 is itself supported on a mount 18 such that it may be moved sidewise of the machine frame or returned to its original position and locked, and one side of said mount 18 is pivotally joined to the frame F by pins 19 while the other side of said mount is joined to the rods 22, 22*a* which are in turn connected to the eccentric shafts 24, 24*a* so that when said eccentric shafts 24, 24*a* are rotated, said other side of the mount is turned downwardly about the pins 19, with one side of the board 15 being positioned below the rail 28*a*, thus allowing easy mounting or adjustment of the mounted position of the board 15 on the support 17. Also, when the support 17 is drawn out from the mount 18, both upper and lower portions of said mount are opened out, so that the positional adjustment of the remover bars 12, 14 in the remover bar frames 12*a*, 14*a* can be made with ease. It is also possible to draw out the remover bar frames 12*a*, 14*a* to one side of the machine frame F by unfastening the locks 37, 37*a* and 38, 38*a* of the blocks 10 and 11, allowing easy and quick mounting and positional adjustment of the remover bars 12, 14 in the respective frames 12*a*, 14*a*.

What is claimed is:

1. A plate type punching machine comprising a machine frame, rails along both sides of the machine frame, endless chain belts guided by the rails, sheet holding pawls carried by the belts, a board on which a sheet held by the sheet holding pawls is placed, a support for said board, a mount on which the support is mounted, rods pivotally joined to one side end of the mount, a first gear, eccentric shafts connecting the first gear and the rods, a handle, and a second gear connected to the handle and meshed with the first gear, said mount having its other side end pivotally joined to the machine frame so that when one side end of the mount is pivoted downwardly by operation of the handle the board and support is drawn out from below the rails to one side of the machine frame.

2. A plate type punching machine according to claim 1 wherein means for removing tailings in sheets resting on the board are provided, said means including remover bars above and below the board, remover bar frames carrying the respective bars, and means so interconnecting the remover bar frames that they are movable vertically relative to each other.

3. A plate type punching machine comprising a machine frame, rails along both sides of the machine frame, endless chain belts guided by the rails, sheet holding pawls carried by the belts, a board on which a sheet held by said sheet holding pawls is placed, a support for said board, said board being movable into or out of one side of the machine frame, and a mount on which said support is mounted, said mount having its one side pivotally joined to the machine frame so that when the other side of said mount is turned downwardly said board and support is drawn out from below the rails to one side of the machine frame, wherein the machine further includes means for removing tailings in sheets resting on the board, said means including remover bars above and below the board, remover bar frames carrying the bars, means so interconnecting the remover bar frames that they are movable vertically relative to each other to remove the tailings, and means for moving the remover bar frames to one side of the machine frame to allow easy mounting and demounting of the remover bars in their frames as well as positional adjustment thereof.

* * * * *

UNITED STATES PATENT AND TRADEMARK OFFICE

CERTIFICATE OF CORRECTION

PATENT NO. : 4,175,477

DATED : November 27, 1979

INVENTOR(S) : Tadao Inose and Minoru Hirota

It is certified that error appears in the above-identified patent and that said Letters Patent are hereby corrected as shown below:

Under [30] Foreign Application Priority Data the date of Japanese application no. 79455 is listed as May 7, 1977 and should be July 5, 1977.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*